US011830420B1

(12) United States Patent
Zhou et al.

(10) Patent No.: US 11,830,420 B1
(45) Date of Patent: Nov. 28, 2023

(54) DISPLAY PANEL, DRIVING METHOD AND DISPLAY DEVICE

(71) Applicant: HKC CORPORATION LIMITED, Shenzhen (CN)

(72) Inventors: Mancheng Zhou, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/327,251

(22) Filed: Jun. 1, 2023

(30) Foreign Application Priority Data

Sep. 26, 2022 (CN) ..... 202211170366.4

(51) Int. Cl.
*G09G 3/32* (2016.01)
*G09G 3/20* (2006.01)

(52) U.S. Cl.
CPC ..... *G09G 3/32* (2013.01); *G09G 3/2096* (2013.01); *G09G 2320/0242* (2013.01); *G09G 2320/0626* (2013.01)

(58) Field of Classification Search
CPC ..... G09G 3/32; G09G 3/2096; G09G 2320/0242; G09G 2320/0626
See application file for complete search history.

(56) References Cited

U.S. PATENT DOCUMENTS 11,189,220 B1 11/2021 Zheng et al.
11,568,803 B1 * 1/2023 Cok ..... G09G 3/32
2003/0160753 A1 8/2003 McCartney
2012/0313923 A1 12/2012 Minami et al.
2013/0314394 A1 11/2013 Chaji et al.
2018/0304151 A1 * 10/2018 Hicks ..... G09G 5/395
2019/0019449 A1 * 1/2019 Pappas ..... G09G 3/32
2022/0244805 A1 * 8/2022 Shi ..... G06F 3/1446
2022/0270543 A1 8/2022 Zhang

FOREIGN PATENT DOCUMENTS

CN 103280189 A 9/2013
CN 106683610 A 5/2017
CN 107024785 A 8/2017
CN 109166556 A 1/2019
CN 109410859 A 3/2019
CN 109427286 A 3/2019
(Continued)

OTHER PUBLICATIONS

First Office Action issued in counterpart Chinese Patent Application No. 202211170366.4, dated Nov. 9, 2022.
(Continued)

*Primary Examiner* — Andrew Sasinowski
(74) *Attorney, Agent, or Firm* — Westbridge IP LLC

(57) ABSTRACT

Disclosed are a display panel, a driving method and a display device. The method includes generating, by the delay component, the gate control signal and sending the gate control signal to corresponding micron-level light-emitting components; and in response to that the gate control signal is detected to meet a voltage condition, intercepting, by each of the micron-level light-emitting components, a column data signal in the column pipe control component based on the gate control signal, and driving a sub-pixel based on the column data signal.

8 Claims, 4 Drawing Sheets

(56) References Cited

FOREIGN PATENT DOCUMENTS

| | | | |
|---|---|---|---|
| CN | 109741716 | A | 5/2019 |
| CN | 109785813 | A | 5/2019 |
| CN | 20200115888 | A | 10/2020 |
| CN | 112136172 | A | 12/2020 |
| CN | 112669740 | A | 4/2021 |
| CN | 112750397 | A | 5/2021 |
| CN | 112820237 | A | 5/2021 |
| CN | 213583060 | U | 6/2021 |
| CN | 113571025 | A | 10/2021 |
| CN | 115273739 | A | 11/2022 |
| KR | 100936399 | B1 | 1/2010 |
| TW | 200839710 | A | 10/2008 |

OTHER PUBLICATIONS

Grant Notification issued in counterpart Chinese Patent Application No. 202211170366.4, dated Dec. 7, 2022.

International Search Report and Written Opinion issued in counterpart PCT Application No. PCT/CN2023/095143, dated Sep. 8, 2023.

* cited by examiner

DISPLAY PANEL, DRIVING METHOD AND DISPLAY DEVICE

CROSS-REFERENCE TO RELATED APPLICATIONS

This application claims priority to Chinese Patent Application No. 202211170366.4, filed on Sep. 26, 2022, the entire contents of which are incorporated herein by reference.

TECHNICAL FIELD

The present application relates to a field of liquid crystal display, and in particular to a display panel, a driving method and a display device.

BACKGROUND

In the existing micro-light emitting diode (Micro-LED) display panel, the color value analog signal can be output based on two display panel architectures, and one of two display panel architectures is the combination of the micron-level light-emitting components, the line pipe control component and the column pipe control component. Multiple line channels are extended out from one line pipe control component to connect to corresponding micron-level light-emitting components, such that the micron-level light-emitting components can receive the enable signal from its corresponding line channel, and collect the column data signal in the column pipe control component based on the enable signal to generate and output the color value analog signal.

However, during producing the display panel as described above, it is found that because it needs multiple line channels corresponding to the micron-level light-emitting components to be extended out from each line pipe control component, the large number of line channels makes the wiring on the display panel complex, which increases the design cost of the display panel and reduces the available area of the display panel at a certain extent, which is not conducive to the development of Micro-LED display panels.

SUMMARY

The main purpose of the present application is to provide a display panel, a driving method and a display device, aiming to solve the technical problem that the existing display panels constructed based on micron-level light-emitting components increase the design cost of the display panel, because it needs multiple line channels corresponding to the micron-level light-emitting components to be extended out from each line pipe control component during production.

In order to achieve the above purpose, the present application provides a display panel, the display panel includes a driving circuit. The drive circuit includes a first control unit and a second control unit; the first control unit includes a line pipe control component, and the second control unit includes an in-plane line pipe unit; the line pipe control component is connected to the in-plane line pipe unit through a line channel; the in-plane line pipe unit is provided with line pipes, each of the line pipes is connected to the line channel through a delay component, and each of the line pipes is connected to micron-level light-emitting components; the line pipe control component is configured to output a communication signal; and the delay component is configured to process the communication signal into a gate control signal and input the gate control signal to the micron-level light-emitting components.

In an embodiment, the delay component includes a resistor and a capacitor, a first end of the resistor is connected to the line channel, a second end of the resistor is connected to a first input of each of the micron-level light-emitting components; and a first end of the capacitor is connected to a point where the resistor is connected to each of the micron-level light-emitting components, and a second end of the capacitor is connected to an isoelectric potential.

In an embodiment, the first control unit further includes a column pipe control component, and the column pipe control component includes a column channel, the column pipe control component is connected to a second input of each of the micron-level light-emitting components through the column channel; and the column channel is connected to the micron-level light-emitting components.

The present application provides a driving method, including: generating, by the delay component, the gate control signal and sending the gate control signal to corresponding micron-level light-emitting components; and in response to that the gate control signal is detected to meet a voltage condition, intercepting, by each of the micron-level light-emitting components, a column data signal in the column pipe control component based on the gate control signal, and driving a sub-pixel based on the column data signal.

In an embodiment, the generating, by the delay component, the gate control signal includes: in response to that the communication signal is received by the delay component from the line pipe control component, generating, by the delay component, the gate control signal based on the communication signal. The line pipe control component is connected to delay components, and a number of gate control signals is the same as a number of the delay components.

In an embodiment, before the in response to that the communication signal is received by the delay component from the line pipe control component, generating, by the delay component, the gate control signal based on the communication signal, the method further includes: receiving, by the line pipe control component and the column pipe control component, a frame start signal and a data signal sent by a timing controller, the frame start signal is a start signal of the line pipe control component sending the communication signal and a line start signal in the column pipe control component, and the data signal is the communication signal in the line pipe control component and the column data signal in the column pipe control component; and starting, by the line pipe control component, to send the communication signal to the delay component based on the frame start signal.

In an embodiment, the in response to that the gate control signal is detected to meet the voltage condition, intercepting, by each of the micron-level light-emitting components, the column data signal in the column pipe control component based on the gate control signal includes: in response to that a voltage corresponding to the gate control signal is detected to reach a preset threshold voltage, confirming, by each of the micron-level light-emitting components, that the gate control signal is detected to meet the voltage condition; and intercepting, by each of the micron-level light-emitting components, the column data signal in the column pipe control component based on the gate control signal at a point-in-time when the voltage corresponding to the gate control signal reaches the preset threshold voltage.

In an embodiment, the intercepting the column data signal in the column pipe control component based on the gate control signal includes: identifying, by each of the micron-level light-emitting components, a line start signal in the column pipe control component based on the gate control signal; and intercepting, by each of the micron-level light-emitting components, the column data signal in the column pipe control component based on the identified line start signal.

In addition, in order to achieve the above purpose, the present application also provides a display device, including the display panel as mentioned above, a memory, a processor and a computer processing program stored on the memory and runnable on the processor. The processor implements the driving method as mentioned above when executing the computer processing program.

The present application advances the structure of the existing display panel. A delay component is added to an end of the line pipe on the in-plane line pipe unit close to the line pipe control component. Based on that the delay component executes function of the line pipe control component generating enable signals, it only needs one line channel to be extended out from one line pipe control component, corresponding multiple micron-level light-emitting components of the line channel can be controlled, thus the number of the line channels is greatly reduced without affecting the function of the display panel. The complex wiring of display panels due to the large number of line channels is avoided and the wiring of display panels becomes more concise, such that not only the design cost of producing display panels is reduced to a certain extent, but also the later maintenance work become easy. The simple wiring also facilitates the later maintenance work, and the favorable development of Micro-LED display panels is ensured.

The achievement of the purpose, function characteristics and advantages of the present application are further described with respect to the drawings in conjunction with the embodiments.

DETAILED DESCRIPTION OF THE EMBODIMENTS

It should be understood that the specific embodiments described herein are intended only to explain the present application and are not intended to limit the present application.

The main solution of the embodiment of the present application is that a delay component is added between the line pipe control component and multiple micron-level light-emitting components. Based on that the delay component executes function of the line pipe control component generating enable signals, it only needs one line channel to be extended out from one line pipe control component, corresponding multiple micron-level light-emitting components of the line channel can be controlled.

In the existing Micro-LED display panel, because it needs multiple line channels corresponding to the micron-level light-emitting components to be extended out from each line pipe control component, the large number of line channels makes the wiring on the display panel complex, which increases the design cost of the display panel to a certain extent and is not conducive to the later maintenance work, and limits the long-term development of Micro-LED display panels.

The present application provides a solution to advance the structure of the existing display panel. A delay component is added to an end of the line pipe on the in-plane line pipe unit close to the line pipe control component. Based on that the delay component executes function of the line pipe control component generating enable signals, it only needs one line channel to be extended out from one line pipe control component, corresponding multiple micron-level light-emitting components of the line channel can be controlled, thus the number of the line channels is reduced without affecting the function of the display panel. The complex wiring of display panels due to the large number of line channels is avoided and the wiring of display panels becomes more concise, such that not only the design cost of producing display panels is reduced to a certain extent, but also the later maintenance work become easy. The simple wiring also facilitates the later maintenance work, the favorable development of Micro-LED display panels is ensured.

Figure 1:
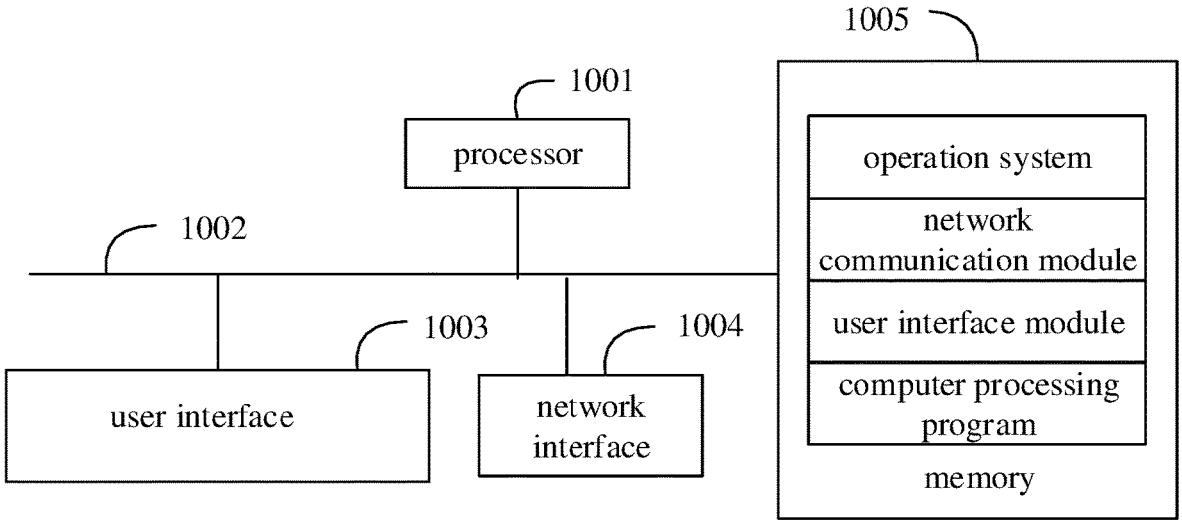
FIG. 1 is a schematic structural view of a terminal of a hardware operating environment according to an embodiment of the present application.

As shown in FIG. 1, FIG. 1 is a schematic structural view of a terminal of a hardware operating environment according to an embodiment of the present application.

A driving method of the embodiment of the present application is applied on a display device, which may include a processor 1001, such as a CPU, a network interface 1004, a user interface 1003, a memory 1005, a communication bus 1002, as shown in FIG. 1. The communication bus 1002 is used to implement the communication among these components. The user interface 1003 may include a display area and an input unit such as keyboard. The user interface 1003 may also include a standard wired interface and a wireless interface. The network interface 1004 can include a standard wired interface and a wireless interface (such as WI-FI interface). The memory 1005 can be a high speed random access memory (RAM), or a stable memory (non-volatile memory), such as a disk memory. The memory 1005 may also be a storage device independent of the aforementioned processor 1001.

The display device may also include a camera, a radio frequency (RF) circuitry, a sensor, an audio circuitry, a WiFi module, and so on. The sensors are, for example, light sensors, motion sensors, and other sensors. Specifically, the light sensors may include an ambient light sensor and a proximity sensor. The ambient light sensor adjusts the brightness of the display based on the brightness of the ambient light, and the proximity sensor turns off the display and/or backlights when the mobile terminal moves to the ear. As a kind of motion sensor, the gravitational acceleration sensor can detect the magnitude of acceleration in all directions (generally three axes) and the magnitude and direction of gravity when stationary, and can be used for applications that identify the posture of the mobile terminal (such as horizontal and vertical screen switching, related games, magnetometer posture calibration), vibration identification-related functions (such as pedometer, knocking), etc. Of course, the mobile terminal can also be configured with a gyroscope, a barometer, a hygrometer, a thermometer, an infrared sensor and other sensors, which will not be repeated here.

It can be understood by those skilled in the art that a structure of the display device shown in FIG. 1 does not constitute a limitation of the display device, and more or fewer components than shown, or a combination of certain components, or a different arrangement of components can be included in the structure of the display device.

As shown in FIG. 1, the memory 1005 as a computer storage medium may include an operating system, a network communication module, a user interface module, and a computer processing program.

In the terminal shown in FIG. 1, the network interface 1004 is mainly used to connect to the background server and communicate data with the background server. The user interface 1003 is mainly used to connect to the client and communicate data with the client, and the processor 1001 can be used to invoke the computer processing program stored in the memory 1005 and performs:

generating, by the delay component, the gate control signal and sending the gate control signal to corresponding micron-level light-emitting components; and in response to that the gate control signal is detected to meet a voltage condition, intercepting, by each of the micron-level light-emitting components, a column data signal in the column pipe control component based on the gate control signal, and driving a sub-pixel based on the column data signal.

In an embodiment, the processor 1001 may invoke the computer processing program stored in the memory 1005 and also performs:

the generating, by the delay component, the gate control signal includes:

in response to that the communication signal is received by the delay component from the line pipe control component, generating, by the delay component, the gate control signal based on the communication signal. The line pipe control component is connected to delay components, and a number of gate control signals is the same as a number of the delay components.

In an embodiment, the processor 1001 may invoke a computer processing program stored in the memory 1005 and further performs:

before the in response to that the communication signal is received by the delay component from the line pipe control component, generating, by the delay component, the gate control signal based on the communication signal, receiving, by the line pipe control component and the column pipe control component, a frame start signal and a data signal sent by a timing controller; the frame start signal is a start signal of the line pipe control component sending the communication signal and a line start signal in the column pipe control component, and the data signal is the communication signal in the line pipe control component and the column data signal in the column pipe control component; and starting, by the line pipe control component, to send the communication signal to the delay component based on the frame start signal.

In an embodiment, the processor 1001 may invoke the computer processing program stored in the memory 1005 and further performs:

the in response to that the gate control signal is detected to meet the voltage condition, intercepting, by each of the micron-level light-emitting components, the column data signal in the column pipe control component based on the gate control signal includes: in response to that a voltage corresponding to the gate control signal reaches a preset threshold voltage, confirming, by each of the micron-level light-emitting components, that the gate control signal is detected to meet the voltage condition; and intercepting, by each of the micron-level light-emitting components, the column data signal in the column pipe control component based on the gate control signal at a point-in-time when the voltage corresponding to the gate control signal reaches the preset threshold voltage.

In an embodiment, the processor 1001 may invoke the computer processing program stored in the memory 1005 and further performs:

the intercepting the column data signal in the column pipe control component based on the gate control signal includes: identifying, by each of the micron-level light-emitting components, a line start signal in the column pipe control component based on the gate control signal; and intercepting, by each of the micron-level light-emitting components, the column data signal in the column pipe control component based on the identified line start signal.

Figure 2:
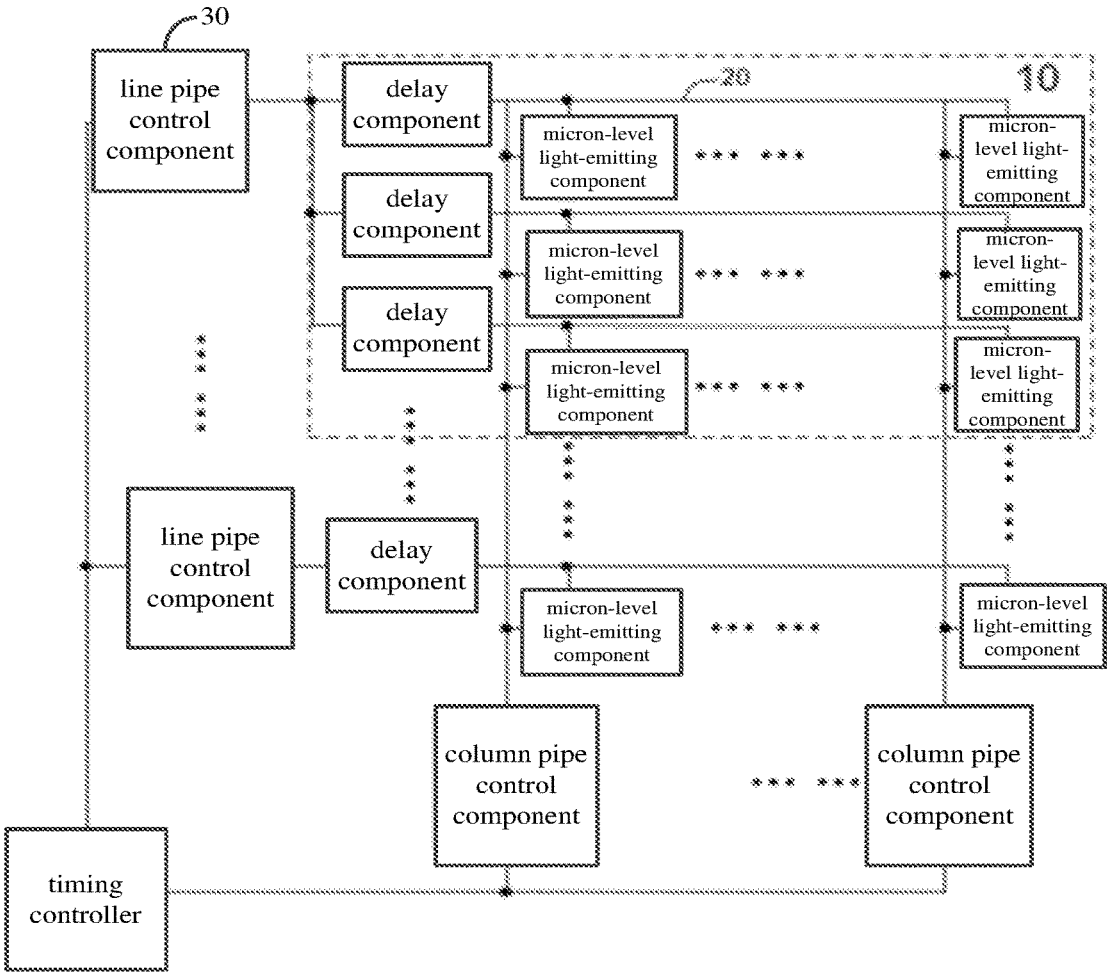
FIG. 2 is a schematic structural view of a display panel.

Referring to FIG. 2, the present application provides a display panel. The display panel includes a drive circuit. The drive circuit includes a first control unit and a second control unit; the first control unit includes a line pipe control component, the second control unit includes an in-plane line pipe unit, and the line pipe control component is connected to the in-plane line pipe unit through a line channel; the in-plane line pipe unit is provided with line pipes, each of the line pipes is connected to the line channel through a delay component, and each of the line pipes is connected to micron-level light-emitting components; the line pipe control component is configured to output a communication signal; and the delay component is configured to process the communication signal into a gate control signal and input the gate control signal to the micron-level light-emitting components.

In an embodiment, the first control unit also includes a column pipe control component, and the column pipe control component includes a column channel;

the column pipe control component is connected to a second input of each of the micron-level light-emitting components through the column channel; and the column channel is connected to the micron-level light-emitting components.

FIG. 2 is an in-plane line pipe unit 10 with three line pipes 20 as an example, each line pipe 20 near an end of the line pipe control component is provided with a delay component, such that the in-plane line pipe unit 10 has three delay components, each delay component is connected to a single line channel 30 extended out from the line pipe control component through the line pipe 20, so that the corresponding micron-level light-emitting components can be controlled without multiple line channels 30 to be extended out from the line pipe control component, that is, one line pipe control component controls three line pipes 20 through a line channel 30. As can be seen from the figures, each line pipe 20 is provided with the same number of n micron-level light-emitting components, and the line pipe is connected to a first input of each of the micron-level light-emitting components, and a second input of each of the micron-level light-emitting components is connected to the column pipe control component. The number of column pipe control components is the same as the number of micron-level light-emitting components on each line pipe 20, so that each of the micron-level light-emitting components can intercept a column data signal in the column pipe control component. It needs to illustrate that ellipsis (shown in FIG. 2) indicates n.

Compared with the existing one line pipe control component, it needs three line channels 30 to be extended out to connect with the in-plane line pipe units 10 respectively, the present application adds a delay component on the line pipe 20 which connects the micron-level light-emitting component and the line pipe control component without affecting the function of the display panel, the number of line channels is greatly reduced to reduce the complexity of the wiring design of the line channels.

The micron-level light-emitting component consists of the light-emitting diode (LED) and the driver chip (IC), the first control unit is for the non-display area in the driver circuit, and the second control unit is for the display area in the driver circuit.

Figure 3:
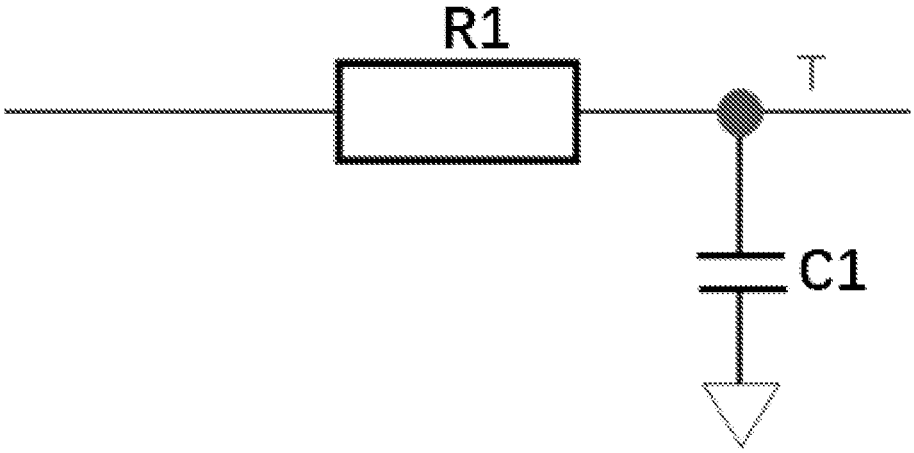
FIG. 3 is a schematic structural view of a delay component.

In an embodiment, referring to FIG. 3, the delay component includes a resistor (i.e., R1 in FIG. 3) and a capacitor (i.e., C1 in FIG. 3); an end of the resistor is connected to the line channel, another end of the resistor is connected to a first input of each of the micron-level light-emitting components, an end of the capacitor is connected to a point where the resistor is connected to each of the micron-level light-emitting components, and another end of the capacitor is connected to an isoelectric potential.

As can be seen in FIG. 3, the delay component consists of a resistor and a capacitor, "T" is a location point, and it is known according to a charging formula of the resistor-capacitor that the T in the figure is expressed by the formula ①:

$$t=RC*Ih[(V_1-V_0)/(V_1-V_t)] \quad ①$$

$V_t$ indicates a real-time voltage of the T, $V_0$ indicates an initial voltage of the T, $V_1$ indicates a final voltage of the T, t indicates the time required for the voltage of the T from $V_0$ to $V_1$, R indicates a size of the resistance in the delay component, C indicates a size of the capacitance, so that the RC value is amended to amend the time required for the voltage of the T from $V_0$ to $V_1$, because the micron-level light-emitting components when detecting that the voltage of the T reaches $V_1$ from $V_0$ will extract the time t, and intercept column data signals in the column pipe control component according to the time t, thus the role of the delay component is equivalent to the role of generating the enabling signal to start the interception of the column data signals. Setting different RC values for the delay component can achieve output of the corresponding color value analog signal at the corresponding time point, such that the display device can display accurate color of the image.

Figure 4:
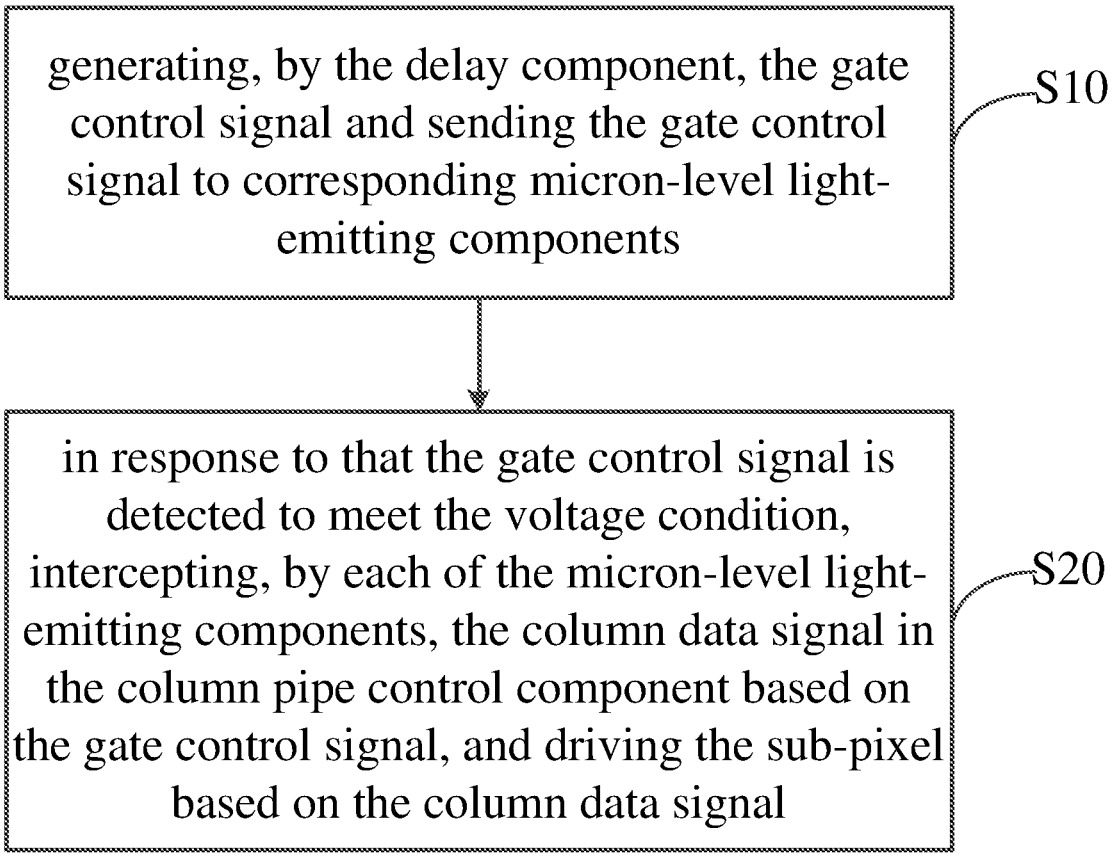
FIG. 4 is a schematic flowchart of a driving method according to an embodiment of the present application.

Referring to FIG. 4, an embodiment of the present application provides a driving method, the driving method includes:

S10, generating, by the delay component, the gate control signal and sending the gate control signal to corresponding micron-level light-emitting components.

Figure 5:
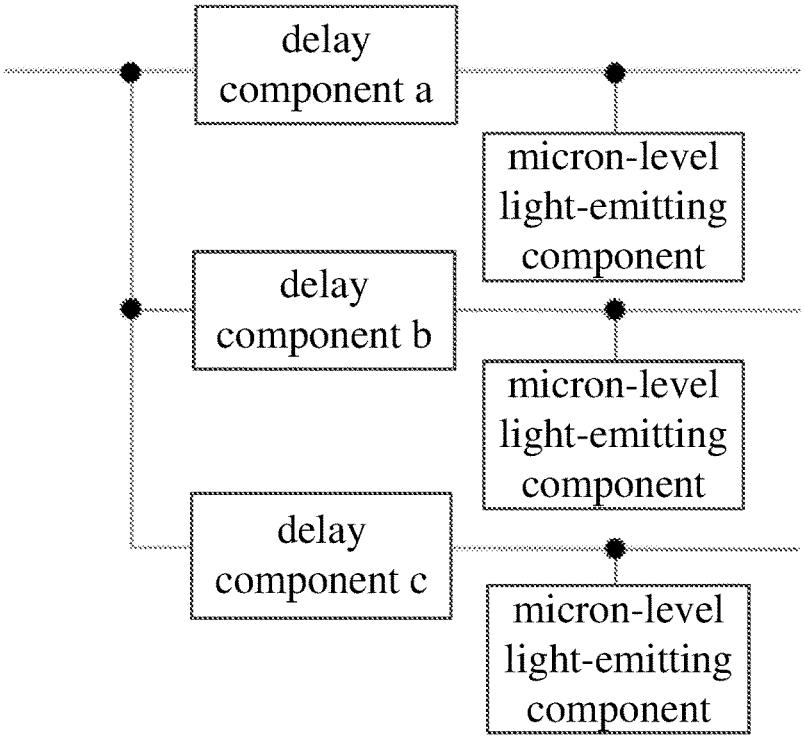
FIG. 5 is a schematic structural view of a single in-plane line pipe unit.

FIG. 5 is taken as an example, FIG. 5 is that when a certain side of the in-plane line pipe unit includes three delay components, a delay component corresponds to one color of light zone, for example, the delay component a corresponds to the red light zone, the delay component b corresponds to the green light zone, the delay component c corresponds to the blue light zone. Therefore, the delay components at this time generate three gate control signals, and the generated gate control signals are output to the corresponding micron-level light-emitting components on the same line pipe for detecting the gate control signals.

The delay component contains a charging circuit consisting of a resistor and a capacitor, and based on the charging time (i.e., time t) provided by the charging circuit, the charging time is associated with the gate control signal, so that the micron-level light-emitting components can detect the charging time through the gate control signal, and performs the next step of driving the sub-pixel when detecting that the voltage in the charging circuit reaches the final voltage at this charging time (i.e., the preset threshold voltage), i.e. the micron-level light-emitting components start to output the red green blue (RGB) analog signal.

The gate control signal is equivalent to a switch to drive the sub-pixel in the next step, when the voltage in the charging circuit at this charging time does not reach the final voltage, the gate control signal continues to output 0 state in the micron-level light-emitting components, and when the voltage in the charging circuit reaches the final voltage at this charging time, the gate control signal changes from 0 state to 1 state, so that the micron-level light-emitting components can perform the next step of driving the sub-pixel based on the time t corresponding to the gate control signal after the 1 state is detected.

In an embodiment, S10, the generating, by the delay component, the gate control signal includes:

in response to that the communication signal is received by the delay component from the line pipe control component, generating, by the delay component, the gate control signal based on the communication signal. The line pipe control component is connected to delay components, and a number of gate control signals is the same as a number of the delay components.

The gate control signal is generated based on the communication signal sent by the line pipe control component. In the embodiment, the line pipe control component sends the communication signal to the in-plane line pipe unit through one line channel, because three delay components are connected to the line channel, so that each delay component can correspondingly receive the communication signal sent by the line pipe control component through the line channel, the delay component can generate the gate control signal based on the received communication signal for detecting the charging time (i.e. time t) of the charging circuit in the delay component.

S20, in response to that the gate control signal is detected to meet a voltage condition, intercepting, by each of the micron-level light-emitting components, a column data signal in the column pipe control component based on the gate control signal, and driving a sub-pixel based on the column data signal.

The micron-level light-emitting component detects that the gate control signal meets the voltage condition, that is, it detects that the gate control signal changes from 0 state to 1 state, then the micron-level light-emitting component determines that there is change in the color of the image displayed by the display device at this point-in-time, while the color of the image is controlled according to the column data signal in the column pipe control component. Therefore, when the gate control signal is detected as 1 state, the micron-level light-emitting component at this time will perform the step of intercepting the column data signal in the column pipe control component, and output the RGB analog signal according to the intercepted column data signal, that is, to drive the sub-pixel, for example, if the micron-level light-emitting component corresponds to the delay component a, the RGB analog signal generated at this time is the R analog signal (that is, the brightness and darkness of red light), and if the micron-level light-emitting component corresponds to the delay component b, the RGB analog signal generated at this time is the G analog signal (that is, the brightness and darkness of green light), and if the micron-level light-emitting component corresponds to the delay component c, the RGB analog signal generated at this time is the B analog signal (that is, the brightness and darkness of blue light), and the generated RGB analog signal is output, such that the color of the image can be changed correspondingly, to drive the sub-pixels without the need for multiple line channels.

In an embodiment, the S20, the in response to that the gate control signal is detected to meet the voltage condition, intercepting, by each of the micron-level light-emitting components, the column data signal in the column pipe control component based on the gate control signal includes:

in response to that a voltage corresponding to the gate control signal is detected to reach a preset threshold voltage, confirming, by each of the micron-level light-emitting components, that the gate control signal is detected to meet the voltage condition; and intercepting, by each of the micron-level light-emitting components, the column data signal in the column pipe control component based on the gate control signal at a point-in-time when the voltage corresponding to the gate control signal reaches the preset threshold voltage.

Because the gate control signal is used for detecting the charging time (i.e., time t) of the charging circuit in the delay component, and the time t is generated based on that the voltage in the charging circuit reaches a preset threshold voltage, thus in the embodiment, the voltage condition of the gate control signal is to detect whether the voltage of its corresponding charging circuit reaches the preset threshold voltage, the preset threshold voltage is the highest voltage on the corresponding line pipe.

Figure 6:
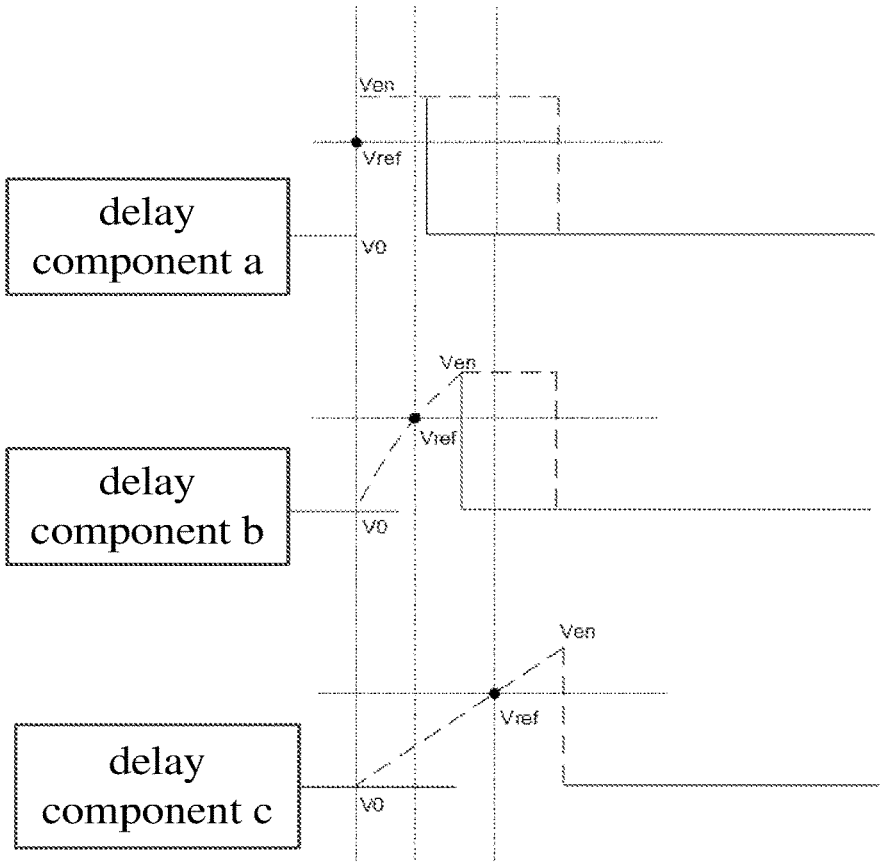
FIG. 6 is a schematic diagram of a voltage waveform of the delay component.

Combined with FIG. 6 and formula ①, it can be seen that at this time, on each line pipe, $V_0=0$, $V_1=V_{EN}$, $V_t=V_{ref}$, therefore, the formula ① at this time can be transformed into formula ②:

$$t=RC*In[V_{EN}/(V_{EN}-V_{ref})] \quad ②$$

As mentioned above, the time t can be amended by amending the RC value, but because the micron-level light-emitting components on the same display panel are the same model, so that the voltage on the line pipe, that is, $V_0$, $V_{EN}$ and $V_{ref}$ are not variable, thus C value of the capacitor in the charging circuit is also not variable, so that $C*IN[V_{EN}/(V_{EN}-V_{ref})]$ in the formula ② is a fixed value, and will be replaced by β, thus the time t can be amended by only amending the R value of the resistor, thus the formula ② at this time can be simplified to the formula ③:

$$t=R\beta \quad ③$$

Combined with FIG. 6 and the formula ③, it can be seen that because the voltage of the delay component a at the starting time is $V_{EN}$, thus the R value of the resistor a in the charging circuit corresponding to the delay component a is 0. Substituting 0 into the formula ③ can obtain that the time to detected by the gate control signal in the micron-level light-emitting components corresponding to the delay component a is 0. Assuming that the R value of the resistor b in the charging circuit corresponding to the delay component b is Rb, then the time tb detected by the gate control signal in the micron-level light-emitting components corresponding to the delay component b is Rb*β, and the R value of the resistor c in the charging circuit corresponding to the delay component c is Rc, then the time tc detected by the gate control signal in the micron-level light-emitting components corresponding to the delay component c is Rc*β.

It should be noted that because each micron-level light-emitting component intercepts the same amount of data in the column data signal in the column pipe control component, the switching time between the line pipes is the same, which leads to tc−tb=tb−0, that is, tc=2tb, which leads to the resistance relationship among the resistor a, resistor b and resistor c as R3=2R2.

Based on above, though the starting time of the voltage on each line pipe is the same, the time t for the voltage on each line pipe to reach the preset threshold voltage is different, because the time t corresponds to a point-in-time when the micron-level light-emitting component intercepts the column data signal in the column pipe control component, such that the micron-level light-emitting components in the in-plane line pipe unit can drive each sub-pixel based on a different point-in-time.

In an embodiment, S20, the intercepting the column data signal in the column pipe control component based on the gate control signal includes:

identifying, by each of the micron-level light-emitting components, a line start signal in the column pipe control component based on the gate control signal; and intercepting, by each of the micron-level light-emitting components, the column data signal in the column pipe control component based on the identified line start signal.

When the micron-level light-emitting component detects, based on the gate control signal, that the voltage of the charging circuit in its corresponding delay component reaches the preset threshold voltage, i.e., the highest voltage on the line pipe, it means that it is time to switch the color of the image. Based on this, the micron-level light-emitting component identifies the line start signal in the column pipe control component, and the line start signal coordinates the interception of the column data signal by the micron-level light-emitting component. Only when the line start signal is identified in the column pipe control component, the column data signal in the column pipe control component can be intercepted, and then the RGB analog signal is output based on the intercepted column data signal, i.e., the sub-pixel is driven to emit light.

In an embodiment, when the gate control signal meets the voltage condition, the micron-level light-emitting component intercepts the column data signal in the column pipe control component through the gate control signal sent by the delay component, to avoid the existing situation of intercepting the column data signal in the column pipe control component only through the enable signal sent by the line pipe control signal, because when judging the interception time of the column data signal through the enable signal, the interception time of the micron-level light-emitting components on the different line pipes is different. Therefore, in order to output different enable signals to the corresponding micron-level light-emitting components, it needs multiple line channels to be extended out from the line pipe control component for connecting to the line channel which is connected to the micron-level light-emitting components. However, when the interception time of the column data signal is judged by the gate control signal sent by the delay component, because the delay component can achieve similar functions as the enable signal sent by the line pipe control component. therefore, it is only necessary to connect one delay component to each line pipe, and the delay component is connected to one line channel extended out from the line pipe control component, so that the line pipe control component can control its corresponding multiple micron-level light-emitting components through one line channel, the number of line channels is reduced greatly without affecting the function of the display panel, to avoid the situation that the design cost increases due to the complex wiring caused by the large number of line channels on the display panel.

Figure 7:
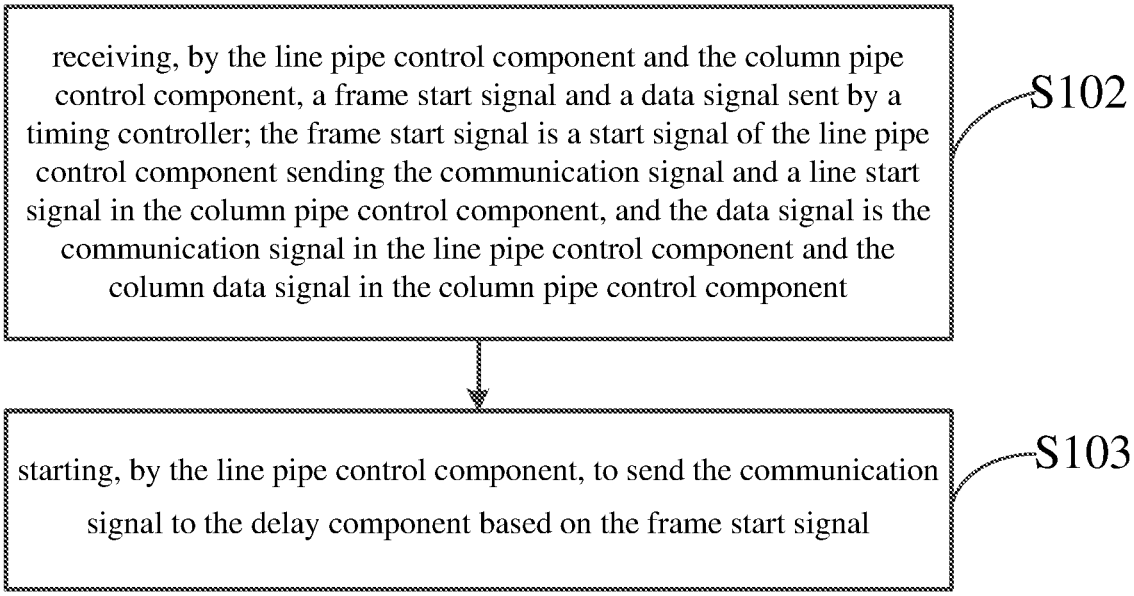
FIG. 7 is a schematic flowchart before S10 in FIG. 4.

Referring to FIG. 7, another embodiment of the present application provides a driving method, before the in response to that the communication signal is received by the delay component from the line pipe control component, the method further includes:

S102, receiving, by the line pipe control component and the column pipe control component, a frame start signal and a data signal sent by a timing controller; the frame start signal is a start signal of the line pipe control component sending the communication signal and a line start signal in the column pipe control component, and the data signal is the communication signal in the line pipe control component and the column data signal in the column pipe control component; and

S103, starting, by the line pipe control component, to send the communication signal to the delay component based on the frame start signal.

The communication signal in the line pipe control component and the line start signal and the column data signal in the column pipe control component are obtained through the timing controller. The timing controller sends the frame start signal and the data signal to the line pipe control component and the column pipe control component by establishing a connection with each line pipe control component and each column pipe control component.

After the line pipe control component receives the frame start signal and the data signal from the timing controller, the line pipe control component transforms the data signal into a communication signal, and sends the communication signal to its corresponding delay component based on the received frame start signal.

The column pipe control component, after receiving the frame start signal and the data signal sent by the timing controller, transforms the data signal into the column data signal and the frame start signal into the line start signal, so that the micron-level light-emitting component can intercept the column data signal based on the identified the line start signal, to avoid intercepting the wrong column data signal.

In the embodiment, the timing controller sends the frame start signal and the data signal to the line pipe control component and the column pipe control component respectively, so that the line pipe control component can send the communication signal to the delay component at the correct point-in-time, so that the micron-level light-emitting component can intercept the correct column data signal in the column pipe control component at the correct point-in-time, which plays a coordinating role for sending of the communication signal and the interception of the column data signal.

In addition, an embodiment of the present application also proposes a display device, the display device includes a display panel, a memory, a processor and a computer program stored on the memory and runnable on the processor, the processor implements the driving method as mentioned above when executing the computer processing program.

It is noted that in the document, the term "including", "comprising", or any other variation thereof is intended to cover non-exclusive inclusion, such that a process, method, article or system comprising a set of elements includes not only those elements, but also other elements that are not explicitly listed, or that are inherent to such process, method, article, or system. Without further limitation, an element defined by the statement "including a" does not preclude the existence of another identical element in the process, method, article, or system that includes these elements.

The above numerical designation of the embodiments of the application is for descriptive purposes only and does not represent the merits of the embodiments.

From the description of the above embodiments, it will be clear to those skilled in the art that the above method can be implemented with the aid of software plus the necessary generic hardware platform, or of course, hardware, but in many cases the former is the better implementation. Based on this understanding, the technical solution of the present application, which essentially or rather contributes to the related art, can be embodied in the form of a software product, which is stored in a storage medium (e.g. ROM/RAM, disk, CD-ROM) as described above, including a number of instructions to enable a terminal device (which can be a cell phone, computer, server, air conditioner, or network device, etc.) perform the method of each embodiment of the present application.

The above is only an embodiment of the present application and is not intended to limit the scope of the patent of the present application. Any equivalent structure or equivalent process transformation made by using the specification of the present application and the accompanying drawings, or direct or indirect application in other related technical fields, is included in the scope of the present application.

What is claimed is:

1. A display panel, comprising a drive circuit, wherein the drive circuit comprises a first control unit and a second control unit;

the first control unit comprises a line pipe control component and a column pipe control component, and the second control unit comprises an in-plane line pipe unit;

the line pipe control component is connected to the in-plane line pipe unit through a line channel;

the in-plane line pipe unit is provided with line pipes, each of the line pipes is connected to the line channel through a delay component, and each of the line pipes is connected to micron-level light-emitting components;

the line pipe control component is configured to output a communication signal;

the delay component is configured to process the communication signal into a gate control signal and input the gate control signal to the micron-level light-emitting components;

the column pipe control component comprises a column channel;

the column pipe control component is connected to a second input of each of the micron-level light-emitting components through the column channel;

the column channel is connected to the micron-level light-emitting components;

the delay component is configured to generate the gate control signal and send the gate control signal to corresponding micron-level light-emitting components; and each of the micron-level light-emitting components is configured to intercept a column data signal in the column control component based on the gate control signal in response to that the gate control signal is detected to meet a voltage condition, and drive a sub-pixel based on the column data signal.

2. The display panel according to claim 1, wherein:

the delay component comprises a resistor and a capacitor;

a first end of the resistor is connected to the line channel, a second end of the resistor is connected to a first input of each of the micron-level light-emitting components; and a first end of the capacitor is connected to a point where the resistor is connected to each of the micron-level light-emitting components, and a second end of the capacitor is connected to an isoelectric potential.

3. A driving method, applied on the display panel according to claim 1, comprising:

generating, by the delay component, the gate control signal and sending the gate control signal to corresponding micron-level light-emitting components; and in response to that the gate control signal is detected to meet the voltage condition, intercepting, by each of the micron-level light-emitting components, the column data signal in the column pipe control component based on the gate control signal, and driving the sub-pixel based on the column data signal.

4. The driving method according to claim 3, wherein the generating, by the delay component, the gate control signal comprises:

in response to that the communication signal is received by the delay component from the line pipe control component, generating, by the delay component, the gate control signal based on the communication signal;

wherein the line pipe control component is connected to delay components, and a number of gate control signals is the same as a number of the delay components.

5. The driving method according to claim 4, wherein before the in response to that the communication signal is received by the delay component from the line pipe control component, generating, by the delay component, the gate control signal based on the communication signal, the method further comprises:

receiving, by the line pipe control component and the column pipe control component, a frame start signal and a data signal sent by a timing controller, wherein the frame start signal is a start signal of the line pipe control component sending the communication signal and a line start signal in the column pipe control component, and the data signal is the communication signal in the line pipe control component and the column data signal in the column pipe control component; and starting, by the line pipe control component, to send the communication signal to the delay component based on the frame start signal.

6. The driving method according to claim 3, wherein the in response to that the gate control signal is detected to meet the voltage condition, intercepting, by each of the micron-level light-emitting components, the column data signal in the column pipe control component based on the gate control signal comprises:

in response to that a voltage corresponding to the gate control signal is detected to reach a preset threshold voltage, confirming, by each of the micron-level light-emitting components, that the gate control signal is detected to meet the voltage condition; and intercepting, by each of the micron-level light-emitting components, the column data signal in the column pipe control component based on the gate control signal at a point-in-time when the voltage corresponding to the gate control signal reaches the preset threshold voltage.

7. The driving method according to claim 3, wherein the intercepting the column data signal in the column pipe control component based on the gate control signal comprises:

identifying, by each of the micron-level light-emitting components, a line start signal in the column pipe control component based on the gate control signal; and intercepting, by each of the micron-level light-emitting components, the column data signal in the column pipe control component based on the identified line start signal.

8. A display device, comprising a display panel, a memory, a processor and a computer processing program stored on the memory and runnable on the processor, wherein the processor implements the driving method according to claim 3 when executing the computer processing program.

* * * * *